US005639418A

United States Patent [19]

Greenwald et al.

[11] Patent Number: 5,639,418

[45] Date of Patent: Jun. 17, 1997

[54] STRIP FLOATER FURNACE WITH CLOSED LOOP RECIRCULATION

[75] Inventors: Roy J. Greenwald, Haskins; Larry L. Rozevink, Wauseon, both of Ohio

[73] Assignee: Surface Combustion, Inc., Maumee, Ohio

[21] Appl. No.: 622,428

[22] Filed: Mar. 25, 1996

[51] Int. Cl.[6] ..... C21D 9/56

[52] U.S. Cl. ..... 266/111; 266/144

[58] Field of Search ..... 266/103, 110, 266/111, 249, 251, 258, 144; 148/657, 656, 661; 432/59

[56] References Cited

U.S. PATENT DOCUMENTS

| | | | |
|---|---|---|---|
| 3,328,997 | 7/1967 | Beggs et al. | 266/111 |
| 4,065,251 | 12/1977 | Croft et al. | 432/59 |
| 4,270,959 | 6/1981 | Matsumoto et al. | 148/153 |
| 5,118,366 | 6/1992 | Shintaku | 266/111 |
| 5,320,329 | 6/1994 | Hoetzl et al. | 266/111 |
| 5,360,203 | 11/1994 | Yamamoto et al. | 266/111 |

*Primary Examiner*—Scott Kastler
*Attorney, Agent, or Firm*—Frank J. Nawalanic

[57] ABSTRACT

A strip floater, heat treat furnace is provided with a plenum housing defining a plenum chamber which is positioned within a refractory lined furnace enclosure. The plenum chamber contains i) a fan housing holding a recirculation fan, ii) a header and pressure pad arrangement for heating and floating strip passing through the furnace, and iii) a recirculation duct for collecting and refreshing spent furnace atmosphere. The entire furnace atmosphere circulation loop from the fan housing through the header and pressure pads and back to the fan housing from the return duct after strip impingement is thus closed and sealed thereby preventing refractory fibre and foreign matter entrainment in the gas streams impinging the strip while improving the temperature control of the furnace atmosphere and strip.

24 Claims, 5 Drawing Sheets

STRIP FLOATER FURNACE WITH CLOSED LOOP RECIRCULATION

This invention relates generally to heat treat furnaces and more particularly to furnaces for heat treating metal strip.

The invention is particularly applicable to and will be described with specific reference to furnaces for treating metal strip, ferrous or non-ferrous, which stably float the strip while the strip travels through the furnace and simultaneously perform a heat treat operation on the strip, such as annealing. However, those skilled in the art will recognize that the invention has broader applications and could be applied to furnaces which perform other heating processes, such as glass annealing, or to systems which simply float web materials, such as roofing materials, while drying the material.

INCORPORATION BY REFERENCE

U.S. Pat. No. 3,328,997 to Beggs et. al and U.S. Pat. No. 5,320,329 to Hoetzl et. al, owned by the assignee, Surface Combustion, Inc., are incorporated by reference herein so that the description of the present invention need not describe in detail strip floatation principles and design details known to those skilled in the art. The patents incorporated by reference do not form part of the present invention.

BACKGROUND

The present invention is an improvement to metal strip, floatation or floater furnaces. Strip floatation furnaces are well known in the art. In such furnaces, metal strip (ferrous or non-ferrous, thick or thin gauge) is heat treated (generally annealing although other heat treat processes such as spherodizing, aging or solution treating are performed) in a furnace through which the strip is pulled at a relatively fast speed (as high as 600 feet per minute). The strip is either uncoiled from coils where it is wound and passes through the furnace or the strip can enter the furnace directly from the mill after passing through looping towers (i.e., an accumulator). After exiting the furnace, the strip typically passes through additional looping towers before being immersed in one or more baths or tanks after which it is wound into coils. Alternatively, the strip may be immediately wound into coils after leaving the furnace.

The floater furnace is a long, box construction which essentially contains pressure pads extending in rows spaced along the length of the furnace extending transversely to the direction of strip movement and situated above and below the strip. The pads direct jet streams of atmosphere in a particular pattern against the strip to suspend or float the strip so that no mechanical contact with the strip can occur. This avoids any strip marking or reduction in gauge thickness which could otherwise occur if strip rolls and the like were used to support the strip within the furnace. Sometimes (and typically) nozzles (formed in pipes extending as rows) are added between the pads to provide sufficient flow of furnace atmosphere or wind so that the strip is raised to the appropriate temperature whereat the heat treating operation can be performed. Depending on the heat treat process, the furnace is typically divided into zones and the temperature (and to a lesser extent the atmosphere) is controlled in each zone. For example, the strip is preheated, heated to the heat treating temperature, and cooled in zones as it travels through the furnace from the entrance to the exit end.

The manner in which the atmosphere is distributed to the pressure pads and nozzle pipes and after impingement, the manner in which the "spent" atmosphere is collected and refined prior to being introduced again as "fresh" atmosphere to the pressure pads and nozzle pipes will vary somewhat from one manufacturer to the next. However, the most pertinent prior art is believe to be the assignee Surface Combustion Inc.'s own floater design which has long been recognized and accepted within the industry.

In the Surface floater furnace, the pressure pad and nozzle pipes are connected at their transverse ends to a manifold or header which in turn is ducted to a fan housing containing a fan. Rotation of the fan impeller causes wind or furnace atmosphere to be pumped under pressure through the headers to the pipes and pads for supporting and effecting heat transfer with the strip as described. A return duct above the pads and pipes and near each end of each furnace "zone" collects the "spent" atmosphere or wind which is pulled by the fan into the fan housing for subsequent distribution to the headers, etc. Within the return duct adjacent its open end are heat transfer tubes which "rejuvenate" the spent atmosphere as it is pulled by the fan through the return duct. This arrangement provides an efficient, compact return loop which has commercially proven itself and which is utilized in the present invention.

The furnace enclosure surrounding and containing the atmosphere distribution system described above is a conventional, furnace construction in which fibrous furnace insulation is applied to the interior of a metal casing. In the Surface design, this insulation is covered with a metal liner to prevent the atmosphere from contacting the insulation, picking up refractory fibers and other foreign matter and transferring them to the strip. That is, the spent jets will circulate randomly throughout the furnace enclosure before being drawn into the return duct. During circulation the wind will impinge the furnace enclosure walls and (if not lined) pick up or entrain refractory particles (and other foreign matter) which will then be pumped back by the fan through the pipes and pads onto the metal strip. To prevent this from occurring, Surface installs a metal, alloy liner over the insulation. Furthermore, the inner metal or panel liner, because of differential temperatures from the furnace enclosure walls, has to be equipped with expansion joints and strips and the like to allow for expansion.

Lining the entire furnace enclosure is relatively expensive (not only from a material cost standpoint but also from an engineering expense since each furnace must be "custom" lined to provide for thermal expansion and contraction). In time the maintenance of the furnace eventually becomes somewhat significant since the expansion strips can eventually fail and expose the insulation to the atmosphere. Also, the blanket fibers can break down and settle. In either instance, the wind within the furnace can entrain foreign matter and impinge the strip. Further, the headers are positioned closely adjacent the furnace enclosure side walls and it becomes difficult to gain access to the furnace enclosure, both for visual inspection to determine failure in the first instance and for repair once the failure is detected.

Other approaches either adopted or suggested by others to address the concerns discussed above have been to utilize other types of furnace insulation coated with a special refractory mortar. However, the mortar is not nearly as durable as the metal liner described above and mortar/refractory arrangements have their own characteristic problems. Other approaches have been to use special hardened ceramic fibre coatings which are more or less "sprayed" onto the insulation producing a smooth surface similar to that of castable refractories. Such insulation is expensive and may crack in time. The repairs then become significant since entire sections of refractory may have to be removed and replaced. Until the present invention, it is believed the metal liner discussed above represented the most durable and functionally the best solution to the problem.

SUMMARY OF THE INVENTION

Accordingly, it is a principle object of the present invention to provide a floater furnace design which entirely eliminates any problem of refractory particle pickup in the furnace atmosphere while simultaneously maintaining better temperature uniformity to the strip with equipment which can be easily inspected and maintained should failure occur.

This object along with other features of the present invention is achieved in a furnace for floating strip which includes a longitudinally-extending, insulated furnace enclosure having an entrance end and an exit end with a plurality of longitudinally spaced, open-ended rows of pressure pads therein, each pressure pad extending transversely to the direction of strip travel. The furnace includes a header in fluid communication with each pressure pad and a fan housing containing a fan for circulating a gaseous medium, which fan housing is in fluid communication with the header. A return duct in fluid communication with the fan housing and the interior of the furnace enclosure is also provided and a heat transfer mechanism associated with the return duct effects heat transfer by contact with the gaseous medium when the fan draws the gaseous medium through the return duct and prior to pumping the gaseous medium through the header. Significantly a plenum housing longitudinally extending within the furnace enclosure is provided and the plenum housing defines a closed plenum chamber contained therein. The plenum housing has an inlet opening adjacent the furnace enclosure inlet end for receiving the strip and an outlet opening adjacent the furnace enclosure exit end permitting the strip to pass out of the furnace enclosure. The plenum chamber sealingly contains at least the return duct and the pressure pads whereby the gaseous medium is retained entirely within the plenum chamber while the plenum housing itself is supported within the furnace enclosure. The plenum housing permits the furnace enclosure which includes longitudinally-extending top, bottom and side furnace walls, each having an outer steel casing with fibrous furnace installation secured to the interior thereof, to have its insulation entirely exposed and facing the interior of the furnace enclosure. Because the inner panel lining is eliminated, the alloy costs of the furnace, even after considering the costs of the plenum housing, is significantly reduced while the durability of the furnace is increased with an attendant decrease in maintenance costs.

In accordance with another aspect of the invention, the plenum housing includes i) transversely extending end walls with each end wall containing one of the plenum openings and each plenum opening configured as a longitudinally-extending throat section, ii) a bottom wall longitudinally extending from the plenum end walls and spaced beneath the bottom row of pressure pads, iii) a pair of longitudinally-extending side walls between the plenum end walls and extending upwardly from the plenum's bottom wall and iv) a longitudinally extending top wall between the plenum end walls and sidewalls. The return duct has a floor wall positioned above the upper row of pressure pads and in conjunction with a portion of the plenum's top wall, forms a portion of the return duct thereby minimizing the alloy costs of the plenum housing. The return duct's floor wall has a transversely extending end adjacent to and spaced from the plenum's opening to define a return duct open end extending between the floor wall and the plenum's top wall for receiving the gaseous medium after the gaseous medium contacts the strip. By forming the plenum housing as a portion of the return duct of the prior art furnace (and also as a portion of the headers), the metal alloy costs of the plenum housing is further minimized reducing the overall costs of the furnace.

In accordance with still yet another feature of the invention, the furnace comprises a plurality of modular, furnace enclosures placed end-to-end through which the strip sequentially passes with each furnace module having insulated, longitudinally-extending top, bottom and side walls, the insulation being conventional blanket furnace insulation affixed to the furnace wall and exposed to the interior of each furnace module as described above. The facing end walls of adjacent furnace modules are not insulated and comprise the end walls of adjacent plenum housings interconnected to each other at their throated openings so that the furnace cost is still further reduced by eliminating the end wall insulation between adjacent furnace modules. Significantly, the interconnected throated openings of adjacent plenum housings create a narrow passageway functioning as a zone barrier preventing gaseous medium within one plenum chamber from entering into the adjacent interconnected plenum chamber whereby the temperature of each adjacent plenum chamber tends to be isolated from one another. This allows the temperature of the strip in each zone or furnace enclosure to be closely controlled improving overall performance of the furnace.

It is thus an object of the invention to provide a strip floater furnace which eliminates the possibility of the furnace atmosphere impinging the strip with refractory particles or any other foreign contaminants.

It is another object of the invention to provide a strip floater furnace which is better able to maintain strip temperature uniformity.

It is a more specific object of the invention to provide an improved strip floater furnace which better isolates the temperature of the strip in each zone from the temperature of the strip in an adjacent zone.

It is another object of the invention to provide a strip floater furnace which is less expensive than conventional strip floater furnaces.

Still another object of the invention is to provide a strip floater furnace which requires less maintenance than conventional strip floater furnaces and if maintenance is required, then the maintenance can be performed in a less expensive manner than that required in conventional, strip floater furnaces.

Yet another specific object of the invention is to provide an improved strip floater furnace which requires less engineering to build than conventional strip floater furnaces.

Yet another general object of the invention is to provide an improved strip floatation furnace which performs better and can be produced at less cost than conventional strip floater furnaces.

These and other objects, features and advantages of the invention will become apparent to those skilled in the art upon reading and understanding the preferred embodiment of the invention described in detail below.

BRIEF DESCRIPTION OF THE DRAWINGS

The invention may take form in certain parts and in an arrangement of certain parts taken together and in conjunction with the attached drawings which form a part of the invention and wherein:

FIG. 6 is a schematic, sectioned plan view of the furnace shown in FIG. 3 taken along lines 6—6 thereof;

DETAILED DESCRIPTION OF THE INVENTION

Figure 1:
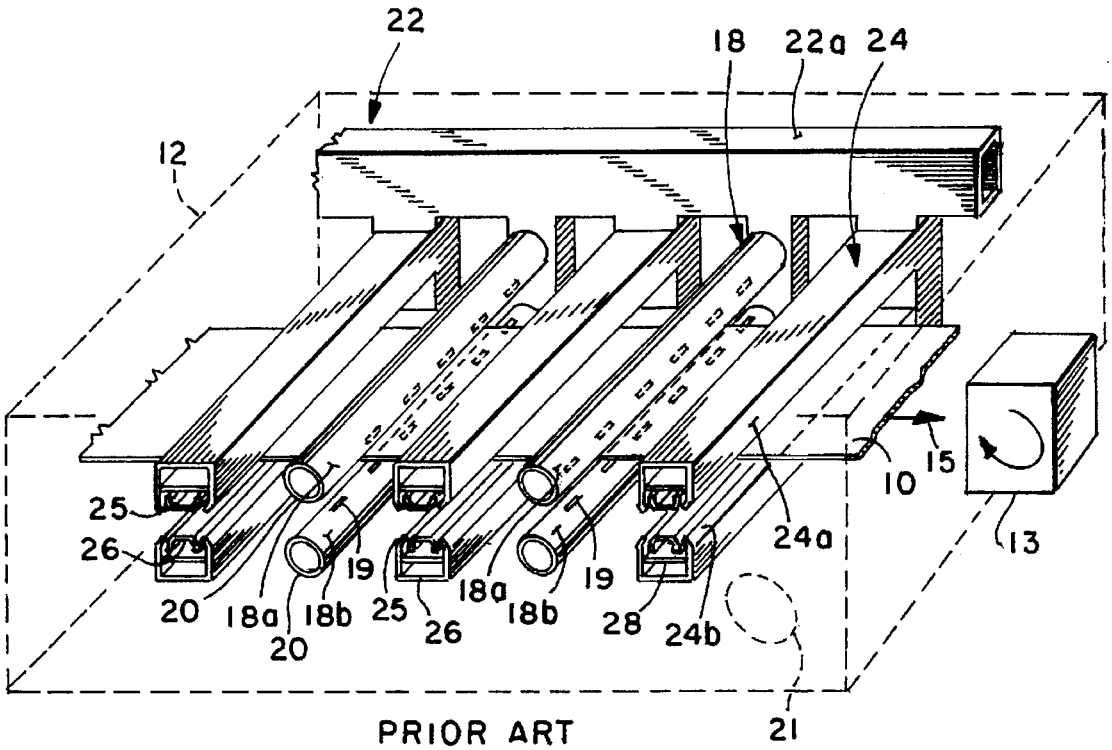
PRIOR ART Fig. 1
FIG. 1 is a perspective, schematic view of a portion of a prior art strip floater furnace.
Figure 2:
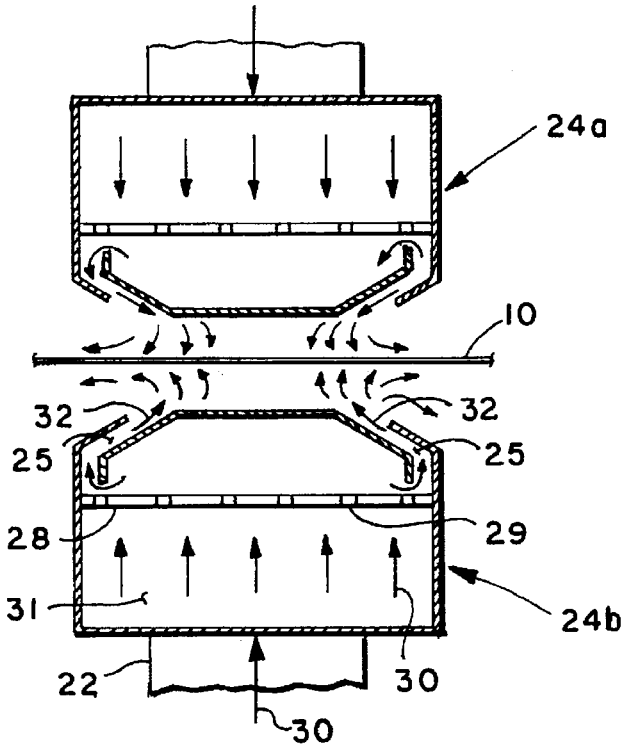
PRIOR ART Fig. 2
FIG. 2 is a schematic, cross-sectioned view of a prior art pressure pad.

Referring now to the drawings wherein the showings are for the purpose of illustrating a preferred embodiment of the invention only and not necessarily for limiting same, there is shown in FIGS. 1 and 2 in schematic form a prior art pressure pad flotation system of the type manufactured and sold by Surface Combustion, Inc., the assignee of the present invention. Reference may be had to U.S. Pat. No. 3,328,997 to Beggs et. al. and to U.S. Pat. No. 5,320,329 to Hoetzl et. al. for a more detailed description of the floatation concepts, principles and designs than that which will be described herein.

In FIG. 1 a metal strip 10 is pulled horizontally by a coil winding mechanism shown schematically by reference numeral 13 through a furnace enclosure 12 shown schematically by dotted lines. Coil winding mechanism 13 could be an accumulator and an uncoiler or accumulator upstream of furnace enclosure 12 is not shown.

In the preferred embodiment metal strip 10 travels horizontally through furnace enclosure 12 although those skilled in the art will understand that metal strip 10 could travel vertically through a vertically extending furnace enclosure 12 and at varying attitudes in between, For consistency in terminology and for definitional purposes as used herein and in the claims, "longitudinally" means the direction of strip travel as shown by reference numeral 15 in FIG. 1, which in the preferred embodiment is, as mentioned, horizontal. Thus when furnace enclosure 12 is defined as longitudinally-extending, this means the furnace extends in the direction of strip travel. "Transversely" means a direction extending at an angle to the longitudinal direction, which in the preferred embodiment is orthogonal to the longitudinal direction but not necessarily limited thereto. "Metal strip" means both light and heavy gauge ferrous and non-ferrous metal strip, typically between 0.004" and 0.250" for heavy gauge aluminum. "Strip" means any web of material including metal strip which can be floated in furnace enclosure 12. "Gaseous medium" means the furnace atmosphere or wind which is circulated within furnace enclosure 12 and which in the preferred embodiment is air although inert gases of compositions well known in the trade are oftentimes used as well as other gas compositions depending on the heat treat process performed by the furnace.

Extending transversely to the direction of strip travel is a plurality of nozzle pipe rows 18 which are longitudinally spaced at equal increments along the length of furnace enclosure 12. Each nozzle pipe row includes a top nozzle pipe 18*a* above strip 10 and a bottom nozzle pipe 18*b* below strip 10. Each nozzle pipe 18*a*, 18*b* has a plurality of openings 19 spaced along its transversely extending length through which a gaseous medium is ejected to effect heat transfer with strip 10. Each nozzle pipe 18*a*, 18*b* is open at its ends 20 (i.e., open-ended) whereat nozzle pipes 18*a*, 18*b* are in fluid communication with a header 22, there being only one side or first header 22*a* shown in FIG. 1 for drawing clarity.

Interspersed between nozzle pipe rows 18 are transversely extending pressure pad rows 24 which are spaced at longitudinal increments along the length of furnace enclosure 12. Each pressure pad row 24 includes a top pressure pad 24*a* above strip 10 and a bottom pressure pad 24*b* beneath strip 10, although in theory at least, top pressure pad 24*a* is somewhat optional. Each pressure pad is slotted as at 25 along its transversely extending length and has open ends 26 (i.e., open ended) in fluid communication with header 22.

Referring now to FIG. 2, each pressure pad 24*a*, 24*b* has a baffle plate 28 with openings 29 therein. A gaseous medium indicated by arrows 30 flows from header 22 into a pressure pad channel 31 bounded by baffle plate 28, through openings 29 whereat gaseous medium is formed as jets indicated by reference numeral 32 emanating from pressure pad slots 25. Jets 32 stably float and even move strip 10 and reference can be had to the patents incorporated by reference herein for a further discussion. For purposes of this invention, it should be noted that pressure pads 24*a*, 24*b* do not significantly affect heat transfer with strip 10 which is, because of jet impingement angle, principally effected by nozzle pipes 18*a*, 18*b*. Nevertheless, the invention in its broader scope can be applied to those drying installations where nozzle pipes 18*a*, 18*b* are omitted.

In the prior art furnace inclosure 12, a stack vent shown by reference numeral 21 controls the pressure in furnace enclosure 12 through a motorized valve.

Furthermore, it should be understood the floatation prior art furnace typically includes several furnace enclosures 12 placed end-to-end through which strip 10 is sequentially placed. Each furnace enclosure 12 acts as a furnace zone affecting one of the heat transfer steps required in the metallurgical process performed by the furnace. Alternatively, or at least in theory, furnace enclosure 12 could be constructed as one self-contained furnace using an internal construction of dropped arches to separate the zones instead of several furnace enclosures 12.

Figure 4:
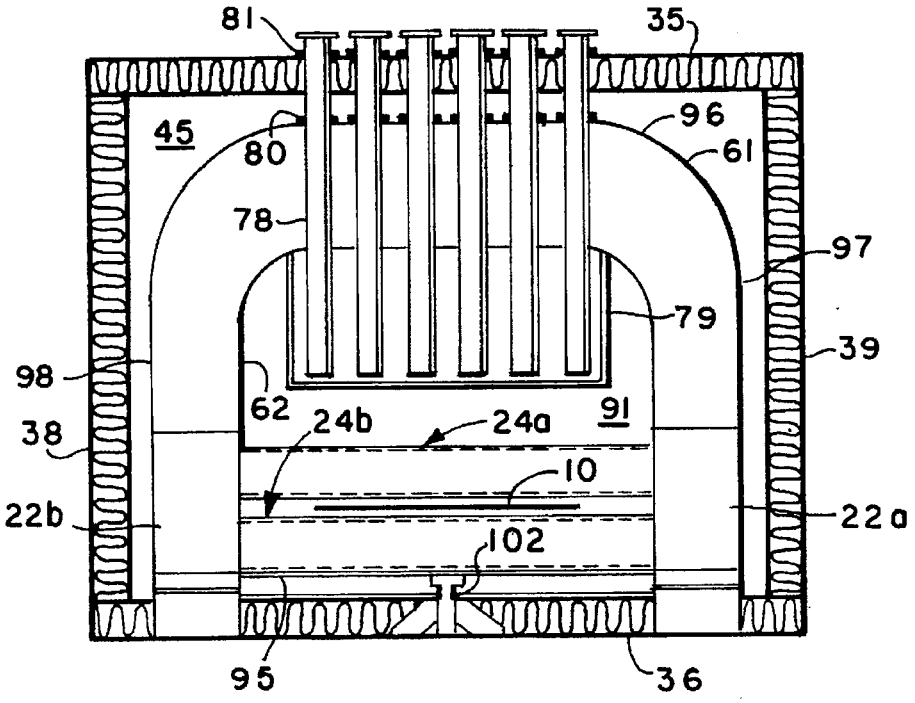
FIG. 4 is a schematic, sectioned view of the furnace shown in FIG. 3 taken along lines 4—4 thereof.
Figure 5:
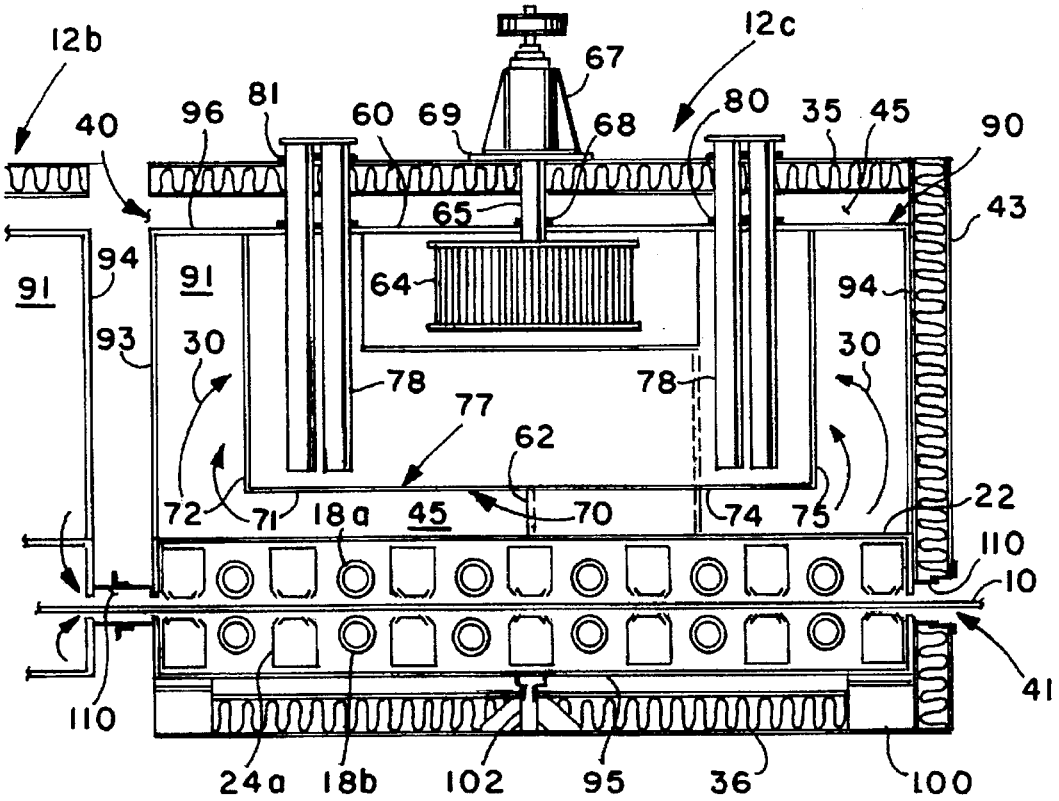
FIG. 5 is a schematic, sectioned view of the furnace shown in FIG. 3 taken along lines 5—5 thereof.
Figure 5:
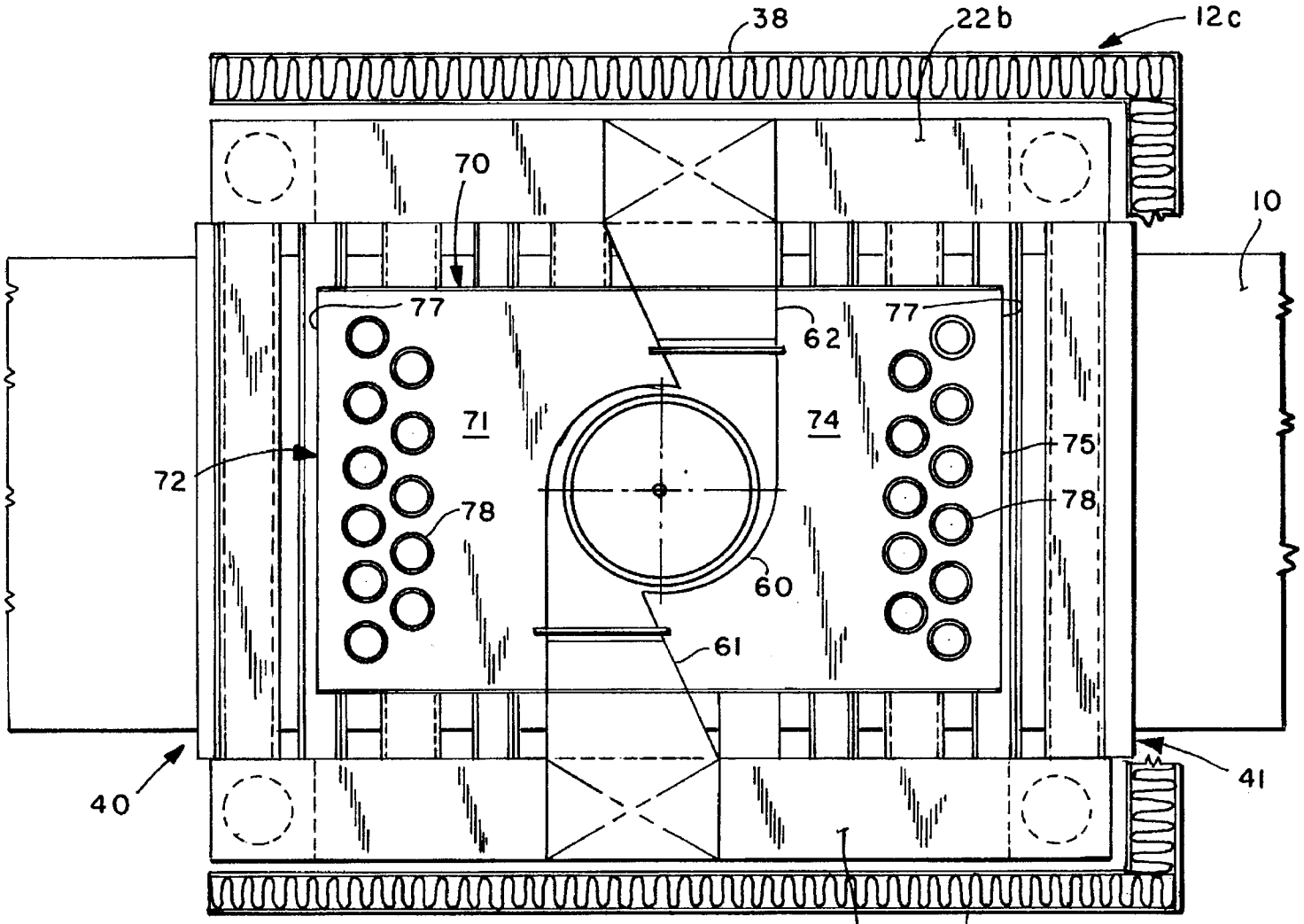
Figure 8:
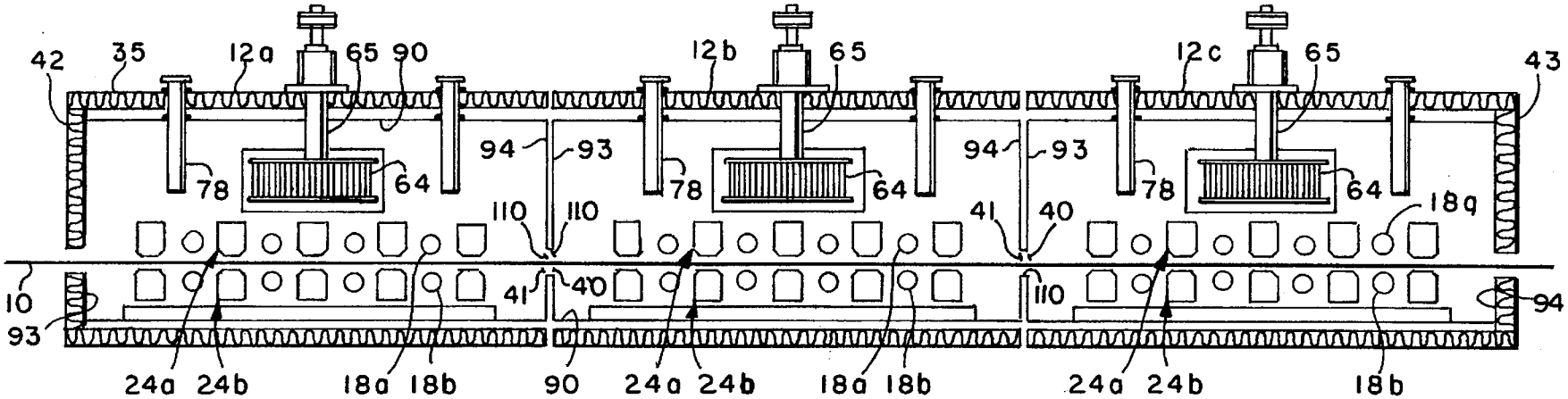
FIG. 8 is a schematic, longitudinally-sectioned view of several modules of the present invention.

Referring now to the construction of the furnace of the present invention and as best shown in FIGS. 4, 5 and 6, each furnace enclosure 12 includes a longitudinally-extending top wall 35, a bottom wall 36, and first and second side walls 38, 39. Each furnace enclosure also has a transversely extending inlet end 40 and a transversely extending exit end 41. For drawing purposes only, FIGS. 5 and 6 illustrate the last exit end 41 for furnace enclosure 12*c* (FIG. 8) in which an insulated exit end wall 43 is provided. (FIG. 8 shows an insulated inlet end wall 42 for first enclosure 12*a*). Each end wall 42, 43 is slotted to allow strip 10 to pass therethrough. In the preferred embodiment, as best shown in FIG. 8, inlet and exit ends 40, 41 of adjacent furnace enclosures 12 which face one another are not insulated. Those skilled in the art will understand that the invention, in the preferred embodiment utilizes furnace enclosures 12 that are either open ended (i.e., 12*b*) or dosed by an insulated inlet end wall 42 (i.e., 12*a*) or insulated outlet end wall 43 (i.e, 12*c*), to minimize furnace cost while not adversely affecting furnace performance, Nevertheless it is within the broader scope of the invention to utilize either a unitary furnace enclosure or a plurality of furnace enclosures placed end to end, each of which is closed by end walls 42, 43 which are insulated. Whether open or closed ended, furnace walls 35, 36, 38 and 39 of furnace enclosure 12 define a furnace enclosure space 45 which in the preferred embodiment is rectangular.

Figure 7:
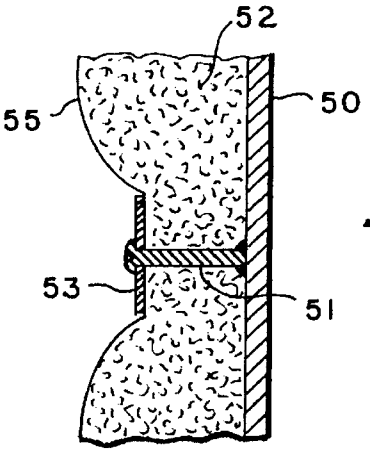
FIG. 7 is a schematic, sectioned view showing furnace insulation applied to the furnace casing of the furnace enclosure.

Insulated furnace walls 35, 36, 38, and 39 (and optionally, end walls 42, 43) employ a typical, furnace insulation construction. As generally illustrated in FIG. 7, each furnace wall includes an outer furnace casing 50 (generally ⅛–3/16 inch plain carbon steel). A plurality of studs 51 are welded to the interior surface of casing 50 and a conventional, furnace refractory fibrous insulation 52 such as blanket insulation available from any number of suppliers, i.e., Thermal Ceramics, is impaled on studs 51. Insulation 52 is secured to furnace casing 50 by clips 53 fitted over the ends of studs 51. Insulation 52 thus presents an exposed surface 55 to furnace enclosure space 45. In the prior art Surface Combustion furnace, exposed insulation surface 55 would be completely covered by a metal liner which would be an alloy (stainless steel) to prevent gaseous medium 30 from contacting and picking up or entraining fibrous insulation particles. The need for the metal liner is eliminated in the present invention. Further, other furnace insulation applications can be employed. For example, refractory or fire brick can be installed on the inside of furnace casing 50 in a conventional manner. No special provisions are required for the mortar.

Figure 3:
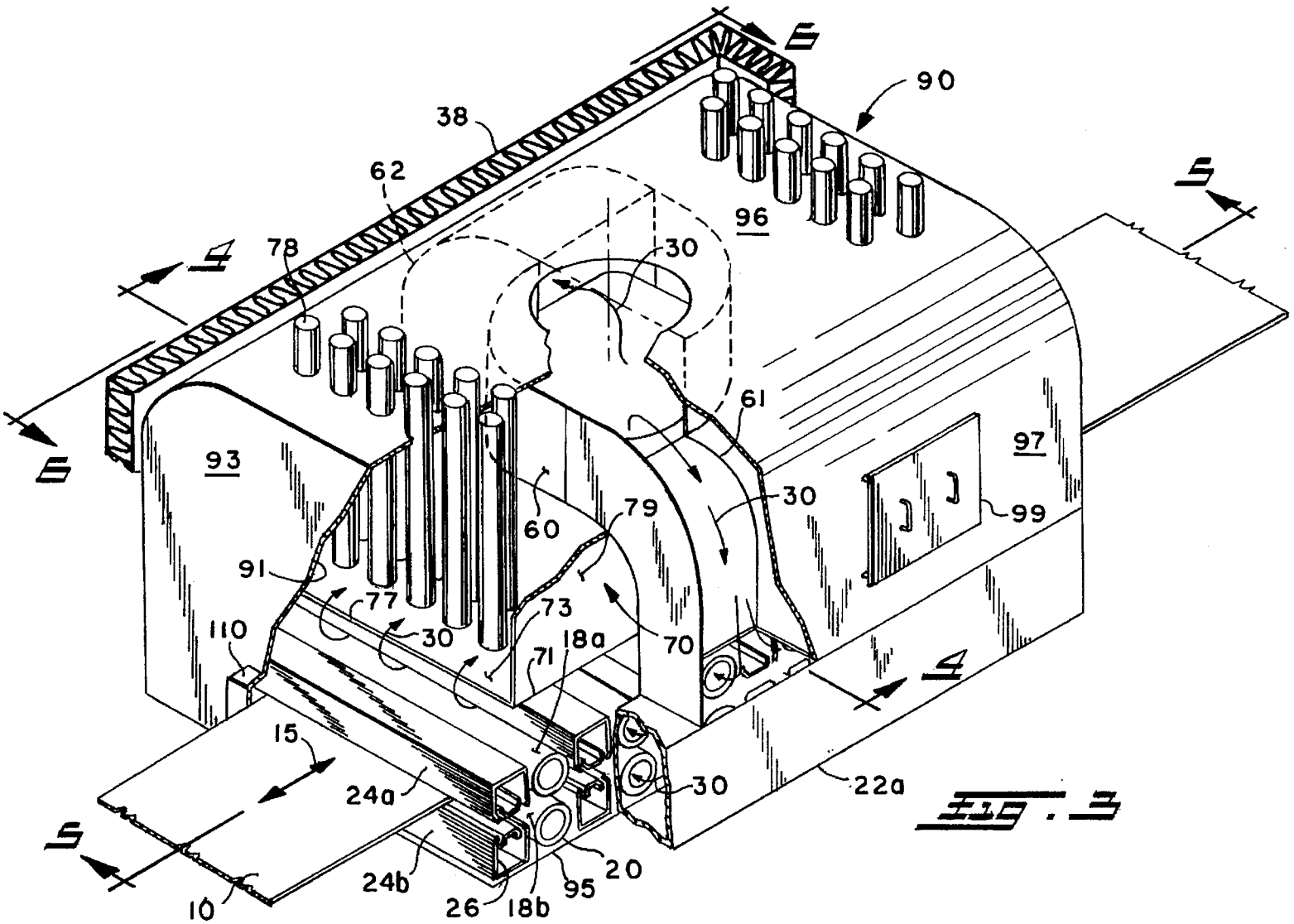
FIG. 3 is a perspective view partially broken away, of the plenum housing and furnace enclosure of the present invention.

As best shown in FIGS. 3, 5 and 6, centered within furnace enclosure space 45 is a fan housing 60 in fluid communication with header 22. Fan housing 60 includes a transversely and downwardly extending first fan housing duct leg 61 secured to first header **22*a* and a longitudinally offset second fan housing duct leg 62 secured to second header 22*b* by which fluid communication between fan housing 60 and header 22 is established. Within fan housing 60 is a fan impeller 64 fixed to a fan shaft 65 extending to a fan bung 67 mounted on furnace casing 12 of top furnace enclosure wall 35 and driven by a motor (not shown). Fan shaft 65 is conventionally sealed as indicated by reference numerals 68, 69 to permit fan housing 60 to thermally expand and contract without admitting ambient air into furnace enclosure space 45. Rotation of fan impeller 64 pumps gaseous medium 30 under pressure to header 22 through pressure pads 24*a*, 24*b* and nozzle pipes 18*a*, 18*b*. Typically, fan flows of about 46,000 ACFM and pressures of about 18" W. C. (inches of water column) are developed in fan housing 60**.

Referring now to FIGS. 3–6, in fluid communication with fan housing 60 and with furnace enclosure space 45 is a return duct 70. Return duct 70 has a first return duct portion 71 longitudinally extending from fan housing 60 to a position adjacent furnace enclosure inlet end 40 and a second return duct portion 74 longitudinally extending from the opposite side of fan housing 60 to a position adjacent furnace enclosure exit end 41. As best shown in FIGS. 3 and 5, return duct 70 extends from fan housing 60 and is open to or in fluid communication with fan impeller 64 while fan duct legs 61, 62 straddle the sides 79 of return duct 70. Return duct 70 includes a floor wall 73 longitudinally extending above upper pressure pad 24 to an end edge 77 which is spaced from inlet and outlet ends 40, 41 to define return duct open ends 72, 75. Rotation of fan impeller 64 causes a suction or under pressure in return duct which draws "spent" gaseous medium 30 into return duct open ends 72, 75 into fan housing 60 where gaseous medium 30 is pressurized etc.

Extending within return duct 70 adjacent open ends 72, 75 is a heat transfer mechanism which in the preferred embodiment comprise heat transfer tubes 78. Heat transfer tubes 78 extend from outside furnace enclosure 12 through furnace enclosure top wall 35 and are conventionally sealed by seals as schematically illustrated by reference numerals 80, 81 which allow relative movement for thermal expansion and contraction without ambient air entering into furnace enclosure space 45. Heat transfer tubes 78 rejuvenate the "spent" gaseous medium as the gas passes by in heat transfer contact with tubes 78 when drawn into fan housing 60. Typically, gas fired burners are mounted to tube ends (not shown) and the tubes have a central partition (not shown). On one side of the partition the burner's products of combustion are discharged while the other side of the partition provides the return leg. For cooling, cooled air is injected into one leg. Alternatively, electric heating elements could be inserted into heat transfer tubes 78 in place of the burners.

As best shown in FIG. 3, the invention includes a plenum housing 90 within furnace enclosure space 45 and plenum housing 90 defines a closed or sealed plenum chamber 91 contained therein. For definitional purposes, plenum chamber 91 contains a portion of furnace enclosure space 45. Within plenum chamber 91 or as part of plenum housing 90 is fan housing 60 including fan duct legs 61, 62, header 22, pressure pads **24*a*, *b*, nozzle pipes 18*a*, *b*, and return duct 70 including a portion of heat transfer tubes 78**. By totally containing the entire recirculation loop, the gaseous medium, even though at high velocity, is protected and can be carefully controlled.

Referring to FIGS. 3–6, plenum housing 90 is defined by i) a transversely extending inlet end wall 93 adjacent furnace enclosure inlet end 40, ii) a transversely extending outlet end wall 94 adjacent furnace enclosure outlet end 41, iii) a bottom wall 95 extending from and between plenum end walls 93, 94, and between the bottom of headers **22*a*, *b*, iv) a top wall 96 extending from and between plenum end walls 93, 94 and v) side walls 97, 98 extending from and between plenum end walls 93, 94 and contiguous with top wall 96 and the top portion of headers of 22*a*, *b***.

Plenum housing 90 is a fabrication of alloy steel (stainless steel anywhere between 1/16" to 3/16" thick) welded together to make a contiguous structure so that walls 93–98 which are adjacent one another are contiguous with one another. Furthermore, a portion of certain walls of plenum housing 90 are contiguous with the flotation structure described thus far. As best shown in FIG. 3, plenum sidewalls 97, 98 are contiguous with the outbound sides of headers **22*a*, 22*b* while plenum bottom wall 95 is contiguous with the bottom of headers 22*a*, 22*b*. Plenum top wall 96 is contiguous with the top surface of fan housing 60 while also forming the roof of top wall of return duct 70. (Return duct 70 is thus shown as a rectangular duct having a roof which is plenum top wall 96, a floor wall 73 and sides 79). An access door 99 is provided for visual inspection of the components housed with in plenum chamber 91. Not shown is an exhaust vent ported to stack which is in fluid communication with plenum chamber 91 and which is designated by reference numeral 21 in FIG. 1 to permit gaseous medium in plenum chamber 91 to be vented if the need arises. Alternatively, a valve in the vent can additionally regulate the pressure within plenum chamber 91**.

As best shown in FIGS. 4 and 5, the entire plenum housing 90 including all the components contained within plenum chamber 91 simply rests on supports extending through furnace enclosure bottom wall 36 and affixed to the furnace foundation (not shown). The supports include four, vertically adjustable, conventional shims 100, one at each longitudinal end of headers 22*a* and 22*b* which have been previously utilized by Surface Combustion, Inc. to support the headers in its prior art floater furnace and a vertically adjustable, pivotable center or king pin support 102. Center support 102 contacts the underside of plenum bottom wall 95. Should significant maintenance be required, furnace enclosure top wall 35 is simply removed and plenum housing 90 lifted off shims 100 and center support 102 and out of furnace enclosure space 45. Repairs can easily be made to furnace enclosure 12 as well as to any of the components contained within plenum chamber 91.

As best shown in FIGS. 3 and 5 each plenum end wall 93, 94 has a longitudinally extending throated opening 110 through which strip 10 passes and each throated opening 110 is adjacent return duct openings 72, 75. When adjacent furnace enclosure 12 are interconnected, the interconnection is done by connecting throated openings 110 together, typically in a sliding fit manner such as diagrammatically shown in FIG. 5. A narrow passageway through which strip 10 travels is thus established by the interconnected throated openings 110 which establishes fluid communication between adjacent plenum chambers 91. Some-what surprisingly this interconnection affects the flow distribution of gaseous medium 30 within plenum chamber 91 at the area adjacent throated opening 100. As shown in FIG. 5, some portion of gaseous medium 30 tends to escape through throated opening 110 by virtue of its longitudinally extending lip configuration adjacent plenum inlet end wall 93 and plenum outlet end wall 94. This is more pronounced and believed significantly more then the prior art construction which simply had slits or slots through the furnace insulation of the furnace enclosure end wall. In the prior art arrangement gaseous medium would simply wipe against the end wall before being turned and drawn through return duct 70. In the present invention some portion of gaseous medium 30 will enter throated opening 110 from one furnace enclosure but it will collide with the gaseous medium entering its throated opening 110 from the adjacent furnace enclosure and the colliding streams establish a stagnation pressure zone in throated opening 110. The result is that gaseous medium from one furnace enclosure cannot enter the adjacent furnace enclosure. Thus, gaseous medium 30 in each plenum chamber 91 cannot escape and is entirely contained within each plenum chamber 91. Because gaseous medium 30 cannot escape nor influence the adjacent furnace zone, the temperature within each zone or furnace enclosure 12 is better controlled. It should be noted that the entrance end of the first furnace enclosure and the exit end of the last furnace enclosure has, as described above, a furnace insulated wall construction with a conventional type slotted opening through which strip 10 passes. Because the first and last end walls are not interconnected, a narrow passageway is not formed and the gaseous medium flow pattern, at the insulated end wall position, is as described for the prior art. The gaseous medium or wind flow through the end wall slots will not be pronounced (no narrow passage) and because the inlet is a "preheat" leg and the final outlet is a "cooling" leg the process is not affected.

In addition to strip temperature stability achieved by zone isolation, it must be recognized that floater furnaces typically operate at "low" furnace temperatures where heat transfer by convection is highly effective. When the spent jets impact the prior art panel liner their temperature can be rapidly changed. The furnace enclosure is rectangular and certain spots or sections at the furnace enclosure walls can be cooler than other sections, resulting in a variation in temperature portions of gaseous stream 312). By enclosing gaseous medium 30 within plenum housing 91, heat transfer by convection from gaseous medium 30 to furnace enclosure walls 35, 36, 38–41 is significantly reduced. Heat transfer occurs from plenum housing 90 to the cold sink furnace enclosure walls 35, 36, 38–41 principally by radiation which, at the relatively lower floater furnace operating temperatures, is minor. There is little temperature gradient imposed on sections of plenum housing 90 from the furnace enclosure walls. The result is less cooling effect of the gaseous medium and therefor better temperature uniformity.

In addition, the life of the entire arrangement is improved with the invention. As already discussed, at floater furnace operating temperatures, whatever temperature gradients exist, the gradients will be relatively minor and steady state in nature. Thus the entire plenum housing 90 and all of its components will thermally expand and contract at about the same rate and the thermal life of plenum housing 90 and its components is believed extended.

In theory, plenum housing 90 of the present invention can be applied to any unitary furnace. However, it is desired for manufacturing costs as well as thermal distortion and control purposes, to maintain the length of furnace enclosure 12 to about 15–17 feet and preferably no more than about 20 feet. Accordingly, the invention encompasses "modulizing" plenum housing 90 and furnace enclosure 12 and then connecting the modular units end to end to produce a strip floater furnace. A strip floater furnace is illustrated in FIG. 8 which includes a preheat furnace enclosure 12*a* (whereat strip 10 is raised in temperature from ambient to its heat treating temperature) connected to a final heat furnace enclosure 12*b* (whereat is maintained at its heat treating temperature so that the heat treating operation, i.e., annealing or aging, can be completed) in turn connected to a cooling furnace enclosure 12*c* (whereat strip 10 is cooled from its heat treating temperature to a lesser temperature). All furnace enclosures 12*a, b* and *c* are identical and will function as described above. Throated opening 110 of plenum outlet end wall 94 for preheat furnace enclosure 12*a* is directly connected to throated opening 110 of plenum inlet end wall 93 of final heat furnace enclosure 12*b*. Similarly, throated opening 110 of plenum outlet end wall 94 of final heat furnace enclosure 12*b* is directly connected to throated opening 110 of plenum inlet end wall 93 of cooling furnace enclosure 12*c*. The only insulated furnace enclosure end walls are the furnace enclosure inlet wall 42 on preheat furnace enclosure 12*a* and furnace enclosure outlet wall 43 on cooling furnace enclosure 12*c*.

The invention has been described with reference to a preferred embodiment. Obviously alterations and modifications will occur to those skilled in the art upon reading and understanding the description of the present invention. It is intended to include all such modifications and alterations within the present invention in so far as they come within the scope thereof.

Having thus defined the invention, it is claimed:

1. A furnace for floating strip comprising:

a) a longitudinally-extending, insulated furnace enclosure having an entrance end and an exit end;

b) a plurality of longitudinally spaced, open-ended rows of pressure pads, each pressure pad extending transversely to the direction of strip travel;

c) a header in fluid communication with each pressure pad;

d) a fan housing containing a fan for circulating a gaseous medium, said fan housing in fluid communication with said header;

e) a return duct in fluid communication with said fan housing and with the interior of said furnace enclosure;

f) heat transfer means associated with said return duct for effecting heat transfer by contact with said gaseous medium when said fan draws said gaseous medium through said return duct and prior to pumping said gaseous medium through said header; and g) a plenum housing longitudinally-extending within said furnace enclosure and defining a closed plenum chamber contained therein, said plenum housing having a plenum inlet opening adjacent said furnace enclosure inlet end for receiving said strip and a plenum outlet opening adjacent said furnace enclosure exit end permitting said strip to pass out of said furnace enclosure, said plenum chamber containing said return duct and said pressure pads whereby said gaseous medium is retained entirely within said plenum chamber.

2. The furnace of claim 1 wherein said furnace enclosure includes longitudinally-extending top, bottom and side furnace walls, each wall having an outer steel casing and fibrous furnace insulation secured to the interior thereof, said fibrous insulation facing and being exposed to the interior of said furnace enclosure whereby said plenum housing prevents said gaseous medium from having any contact with said fibrous insulation.

3. The furnace of claim 2 wherein said plenum housing includes i) a pair of longitudinally spaced transversely extending plenum end walls, each plenum end wall containing one of said plenum openings, each plenum opening configured as a longitudinally-extending throat section, ii) a longitudinally-extending plenum bottom wall extending between said plenum end walls and spaced from one side of said pressure pads, iii) a pair of transversely spaced, longitudinally-extending plenum side walls extending away from said plenum bottom wall and positioned between said plenum end walls; and iv) a longitudinally extending plenum top wall between said plenum end walls and said plenum side walls;

said return duct having a floor wall spaced from the opposite side of said pressure pads, said floor and said plenum's top wall forming a portion of said return duct, said return duct's floor having a transversely extending end adjacent to and spaced from said plenum's opening to define a return duct open end extending between said floor and said plenum's top wall for receiving said gaseous medium after said gaseous medium contacts said strip; and said heat transfer means situated within and adjacent said return duct's open ends.

4. The furnace of claim 3 wherein said plenum's top wall is contiguous with said plenum's side walls and end walls, said plenum's side walls are contiguous with said plenum's end walls, said plenum bottom wall and said header, and said plenum's bottom wall is contiguous with said plenum's end walls, side walls and said header.

5. The furnace of claim 4 wherein said furnace includes a plurality of identical furnace enclosures placed adjacent one another end-to-end so that said strip passes sequentially through said furnace enclosures, each furnace enclosure having a plenum housing contained therein longitudinally-extending no more than about 20 feet.

6. The furnace of claim 5 wherein said throat opening of one plenum's end wall of one furnace enclosure interconnects with the throat opening of an adjacent plenum's end wall of an adjacent furnace enclosure to define a throated passageway interconnecting adjacent plenum housings to one another, said throated passageway preventing gaseous medium within one plenum chamber from entering into the adjacent interconnected plenum chamber whereby the temperature within each adjacent plenum chamber is isolated from one another.

7. The furnace of claim 6 wherein said adjacent furnace enclosures have uninsulated end openings facing one another.

8. The furnace of claim 7 wherein that furnace enclosure's end openings adjacent the initial entrance end of said strip into said furnace and that furnace enclosure's end opening adjacent the final, exit end of said strip from said furnace is insulated.

9. The furnace of claim 8 wherein said furnace enclosure's top wall is removable to permit said plenum housing including said return duct, said headers and said fan housing to be vertically lifted and removed from said furnace enclosure as a unit from said furnace enclosure so that furnace maintenance can be performed.

10. The furnace of claim 1 wherein said furnace includes a plurality of identical furnace enclosures placed adjacent one another end-to-end so that said strip passes sequentially through said furnace enclosure, each furnace enclosure having a plenum housing contained therein longitudinally-extending no more than about 20 feet.

11. The furnace of claim 10 wherein said inlet opening of one plenum interconnects with said exit opening of an adjacent plenum to define a passageway interconnecting adjacent plenum housings to one another, said passageway preventing gaseous medium within one plenum chamber from entering into the adjacent interconnected plenum chamber whereby the temperature within each adjacent plenum chamber tends to be isolated from one another.

12. The furnace of claim 11 wherein said adjacent furnace enclosures have open end openings facing one another.

13. A furnace for supporting and transferring heat to metal strip continuously moving through the furnace comprising:

a) a plurality of modular, longitudinally-extending furnace enclosures placed end-to-end through which said strip sequentially passes, each furnace enclosure having transversely spaced end openings and insulated, longitudinally-extending top, bottom and side walls between said end openings;

b) each furnace enclosure containing a plurality of open ended pressure pads and nozzle pipes situated above and below said strip and extending transversely to the direction of strip travel, said pipes interspersed between said pads along the length of said furnace enclosure;

c) a longitudinally-extending header secured at each end of said pads and said pipes and in fluid communication therewith for directing a gaseous medium against said strip whereby said strips are supported while effecting heat transfer therewith, each header adjacent a furnace enclosure side wall;

d) a fan housing in fluid communication with each header, said fan housing containing a fan impeller for circulating said gaseous medium;

e) a longitudinally-extending first return duct having an open end generally adjacent one of said furnace enclosure's end openings and a longitudinally extending second return duct having an open end generally adjacent the opposite furnace enclosure's end opening, each return duct in fluid communication with said fan housing;

f) heat transfer means within each return duct for effecting heat transfer with said gaseous medium drawn through each return duct and pumped into said headers by said fan impeller; and g) a plenum housing extending between and secured to said headers and defining a plenum chamber sealingly containing said pads and pipes, said return ducts and said fan housing whereby said gaseous medium is prevented from striking said furnace enclosure walls.

14. The furnace of claim 13 wherein each furnace enclosure's top, bottom and side walls have an outside metal casing and exposed furnace insulation applied to the interior thereof.

15. The furnace of claim 14 said plenum housing includes i) a pair of longitudinally spaced transversely extending plenum end walls, each plenum end wall containing one of said plenum openings, each plenum opening configured as a longitudinally-extending throat section, ii) a longitudinally-extending plenum bottom wall extending between said plenum end walls and spaced from one side of said pressure pads, iii) a pair of transversely spaced, longitudinally-extending plenum side walls extending away from said plenum bottom wall and positioned between said plenum end walls; and iv) a longitudinally extending plenum top wall between said plenum end walls and said plenum side walls;

said return duct having a floor wall spaced from the opposite side of said pressure pads, said floor and said plenum's top wall forming a portion of said return duct, said return duct's floor having a transversely extending end adjacent to and spaced from said plenum's opening to define a return duct open end extending between said floor and said plenum's top wall for receiving said gaseous medium after said gaseous medium contacts said strip; and said heat transfer means situated within and adjacent said return duct's open ends.

16. The furnace of claim 15 wherein said plenum's top wall is contiguous with said plenum's side walls and end walls, said plenum's side walls are contiguous with said plenum's end walls, said plenum bottom wall and said header, and said plenum's bottom wall is contiguous with said plenum's end walls, side walls and said header.

17. The furnace of claim 16 wherein said throat opening of one plenum's end wall of one furnace enclosure slidingly interconnects with said throat opening of an adjacent plenum's end wall of an adjacent furnace enclosure to define a throated passageway interconnecting adjacent plenum housings to one another, said throated passageway preventing gaseous medium within one plenum chamber from entering into the adjacent interconnected plenum chamber whereby the temperature within each adjacent plenum chamber is isolated from one another.

18. The furnace of claim 17 wherein said adjacent furnace enclosures have open end openings facing one another.

19. The furnace of claim 18 wherein that furnace enclosure's end openings adjacent the initial entrance end of said strip into said furnace and that furnace enclosure's end opening adjacent the final, exit end of said strip from said furnace is insulated.

20. In a metal strip floater furnace having a furnace enclosure defined by longitudinally-extending top, bottom and side walls containing transversely extending pressure pads and interspersed nozzle pipes above and below the strip, said pipes and pads in fluid communication with first and second headers within said enclosure, said headers in fluid communication with a fan housing containing a fan for pumping wind to said strip through said headers to said pads and pipes, said fan housing in fluid communication with a return duct having an open end adjacent the entrance and exit ends of said furnace enclosure having heat transfer means for changing the temperature of said wind when said fan causes said wind to be drawn through said return duct after impacting said strip, the improvement comprising:

said furnace enclosure top, bottom and side walls having exposed, insulation secured to the insides thereof; and a plenum housing defining a dosed plenum chamber containing said pads and pipes, said header, said fan housing and said return duct whereby said wind is prevented from contacting said insulation.

21. The furnace of claim 20 wherein said plenum housing includes i) a pair of longitudinally spaced transversely extending plenum end walls, each plenum end wall containing one of said plenum openings, each plenum opening configured as a longitudinally-extending throat section, ii) a longitudinally-extending plenum bottom wall extending between said plenum end walls and spaced from one side of said pressure pads, iii) a pair of transversely spaced, longitudinally-extending plenum side walls extending away from said plenum bottom wall and positioned between said plenum end walls; and iv) a longitudinally extending plenum top wall between said plenum end walls and said plenum side walls;

said return duct having a floor wall spaced from the opposite side of said pressure pads, said floor and said plenum's top wall forming a portion of said return duct, said return duct's floor having a transversely extending end adjacent to and spaced from said plenum's opening to define a return duct open end extending between said floor and said plenum's top wall for receiving said gaseous medium after said gaseous medium contacts said strip; and said heat transfer means situated within and adjacent said return duct's open ends.

22. The furnace of claim 21 wherein said furnace includes a plurality of identical furnace enclosures placed adjacent one another end-to-end so that said strip passes sequentially through said furnace enclosures, each furnace enclosure having a plenum housing contained therein longitudinally-extending no more than about 20 feet.

23. The furnace of claim 22 wherein said throat opening of one plenum's end wall of one furnace enclosure interconnects with said throat opening of an adjacent plenum's end wall of an adjacent furnace enclosure to define a throated passageway interconnecting adjacent plenum housings to one another, said throated passageway preventing gaseous medium within one plenum chamber from entering into the adjacent interconnected plenum chamber whereby the temperature within each adjacent plenum chamber is isolated from one another.

24. The furnace of claim 23 wherein said furnace enclosure's top wall is removable to permit said plenum housing including said return duct, said headers and said fan housing to be vertically lifted and removed from said furnace enclosure as a unit from said furnace enclosure so that furnace maintenance can be performed.

* * * * *